US011839269B2

(12) United States Patent
Bouquier

(10) Patent No.: US 11,839,269 B2
(45) Date of Patent: Dec. 12, 2023

(54) ADJUSTMENT SYSTEM WITH IMPROVED OPERATION, METHOD FOR MANUFACTURING ONE SUCH ADJUSTMENT SYSTEM AND ADJUSTMENT METHOD

(71) Applicant: ZEDEL, Crolles (FR)

(72) Inventor: Benoît Bouquier, Corenc (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 17/874,953

(22) Filed: Jul. 27, 2022

(65) Prior Publication Data

US 2023/0030488 A1 Feb. 2, 2023

(30) Foreign Application Priority Data

Jul. 27, 2021 (FR) ..... 2108123

(51) Int. Cl.
*A44B 11/18* (2006.01)

(52) U.S. Cl.
CPC ..... *A44B 11/18* (2013.01)

(58) Field of Classification Search
CPC ..... A44B 11/18; A44B 11/12; A41F 11/12; A41F 15/002
See application file for complete search history.

(56) References Cited

U.S. PATENT DOCUMENTS 362,595 A * 5/1887 Allen ..... A44B 11/12 24/170
368,529 A 8/1887 Harris
666,770 A * 1/1901 Miller ..... A41F 11/12 24/191
849,004 A 4/1907 Maltby
1,697,833 A 1/1929 Lane
2,563,809 A 8/1951 Ash
2,807,852 A 10/1957 Rave
5,432,984 A 7/1995 Petzl
6,802,109 B2 * 10/2004 Hede ..... A44B 11/28 24/165
8,381,366 B2 2/2013 Hede et al.
9,433,260 B2 9/2016 Hede et al.
2004/0169411 A1 * 9/2004 Murray ..... B60R 22/105 280/801.1

(Continued)

FOREIGN PATENT DOCUMENTS

EP 0 614 626 A1 9/1994
EP 2 946 682 A1 11/2015

(Continued)

*Primary Examiner* — Robert Sandy
*Assistant Examiner* — Louis A Mercado
(74) *Attorney, Agent, or Firm* — Oliff PLC

(57) ABSTRACT

An adjustment system is configured to adjust the length of a first strap. The adjustment system includes a ring defining a first through hole in a first direction. A pin is fitted movable with respect to the ring. The pin partially obstructs the ring in the first direction so as to divide the first through hole into a second through hole and a third through hole separated from the second through hole by the pin. The adjustment system includes a tab at least partially blanking off the first through hole in the first direction. The tab is arranged at a distance from the pin to define a space for the first strap to pass between the pin and the tab.

16 Claims, 4 Drawing Sheets

(56) References Cited

U.S. PATENT DOCUMENTS

| | | | | |
|---|---|---|---|---|
| 2007/0187445 | A1 | 8/2007 | Krapka | |
| 2021/0186164 | A1* | 6/2021 | Emonin ..... | A44B 11/18 |

FOREIGN PATENT DOCUMENTS

| | | | |
|---|---|---|---|
| FR | 1555221 | A | 1/1969 |
| FR | 2 996 732 | A1 | 4/2014 |
| GB | 10719 | A | 8/1913 |

* cited by examiner

ADJUSTMENT SYSTEM WITH IMPROVED OPERATION, METHOD FOR MANUFACTURING ONE SUCH ADJUSTMENT SYSTEM AND ADJUSTMENT METHOD

BACKGROUND OF THE INVENTION

The invention relates to an adjustment system, a method for manufacturing one such adjustment system and an adjustment method making use of one such adjustment system.

STATE OF THE ART

In the fields of work at height, caving and mountaineering, it is common practice to use harnesses having adjustment straps collaborating with an adjustment system in the form of an adjustment buckle. The adjustment straps are used to adjust the circumference of a leg loop and/or to adjust the length of a shoulder strap.

It is conventional to use an adjustment buckle with a ring and a strap that passes though the ring. The ring is partially obstructed by a pin mounted movable with respect to the ring. The strap passes a first time through the hole of the ring and then passes round the pin and comes back inside the ring. Once the strap has been pulled tight, the pin moves in the direction of one end of the ring enabling the strap to be secured between the pin and the ring. Different adjustment buckle configurations are known in particular those disclosed in the documents EP0614626, FR2996732, EP2946682, U.S. Pat. No. 9,433,260, US2007/0187445, U.S. Pat. Nos. 1,697,833, 2,563,809 and 2,807,852.

In the first place, the adjustment system has to be easy to use. It must in particular allow the strap to slide easily to enable the latter to be adjusted precisely to the required length. It also has to enable the adjustment applied to the strap to be retained when the latter is subjected to load.

To keep the required length of the strap by means of the adjustment buckle, different solutions have been proposed. Adjustment systems equipped with a locking cover are known. The cover is mounted movable in rotation between a first position allowing sliding of the strap and a second position that blocks the strap in the selected position. The cover presses on the strap to prevent any movement of the strap. The locking cover then has to be deactivated to perform adjustment of the strap. Such a technical solution is cumbersome and rather impractical in the tree care field as branches may actuate the locking cover. This technical solution involves the use of a large number of parts which limits its advantageousness.

In another technical field, the document US 2004/0169411 discloses installation of a blocking clamp made from textile material of VELCRO® type. The blocking clamp opens to allow access to the adjustment loop and therefore to enable the shoulder strap webbing to be adjusted. When the blocking clamp is reclosed, the loop is no longer accessible and prevents adjustment. This solution is not practical as it requires installation of an additional bulky part around the adjustment buckle. In the field of work at height and mountaineering, it is commonplace to work with gloves so that the clamp has to be able to be used when wearing gloves such as those used in work at height which means that a sizeable blocking clamp is required. Such a technical solution is not practicable.

Different configurations of adjustment loops are known and a great deal of optimisation work has been carried out to improve the strength under load and the sliding of the strap. It is known to form gripping spikes on an inner surface of the ring so that the gripping spikes penetrate into the strap thereby keeping the adjustment under load. However, the gripping spikes that insert into the thickness of the strap may impede sliding of the latter. Work is carried out on the shape of the buckle and the edges of the buckle to facilitate sliding and to keep the adjustment under load without generating premature wear of the strap by a too large friction.

In spite of this optimisation work, a certain number of users indicate a loss of adjustment of the length of the strap which means that the user has to regularly readjust the adjustment system to define the required length of a leg loop or a shoulder strap. This situation is particularly tedious for people who use their harness every day.

SUMMARY OF THE INVENTION

One object of the invention consists in remedying these shortcomings, and more particularly in providing an adjustment system that ensures a better preservation of the selected position for a strap in the adjustment system while at the same time remaining simple to use without penalising the strength of the adjustment under load.

These shortcomings tend to be overcome by means of an adjustment system configured to adjust the length of a first strap comprising:

- a ring defining a first through hole in a first direction;
- a pin mounted movable with respect to the ring, the pin partially obstructing the ring in the first direction so as to divide the first through hole into a second through hole and a third through hole separated from the second through hole by the pin.

The adjustment system is remarkable in that it comprises a tab at least partially blanking off the first through hole in the first direction, the tab being placed at a distance from the pin to define a space for the first strap to pass between the pin and the tab.

According to one feature of the invention, the tab is made from flexible material.

In preferential manner, the tab is made from polymer material.

Advantageously, the tab is fixed only to the ring.

In a particular embodiment, the tab is installed in removable manner on the ring.

According to another feature, the adjustment system comprises an additional ring mounted movable with respect to the ring, the pin forming a part of the additional ring. The tab is fixed only to the additional ring.

In another preferential development, the tab is installed in removable manner on the additional ring.

In an alternative embodiment, a permanently closed textile loop surrounds a part of the ring and passes through the first through hole. The tab is fixedly mounted on the textile loop.

Advantageously, the strap passes through the first through hole and the second through hole. A distance separating the pin and the tab in a first direction is greater than a thickness of the strap in the first direction.

It is a further object of the invention to provide a harness for which the strap adjustments are better retained. This result tends to be achieved by means of a roping harness comprising an adjustment system according to any one of the foregoing configurations in which the adjustment system is configured to adjust the circumference of a leg loop. This result also tends to be achieved by means of a roping harness comprising an adjustment system according to any one of the foregoing configurations in which the adjustment system is configured to adjust the length of a shoulder strap.

It is yet a further object of the invention to provide a method for manufacturing an adjustment loop that is easy to implement and that enables the adjustment of the first strap to be better retained.

This result tends to be achieved by means of a method for manufacturing an adjustment system comprising the following steps:

providing a ring defining a first through hole in a first direction and a pin mounted movable with respect to the ring, the pin partially obstructing the ring in the first direction so as to divide the first through hole into a second through hole and a third through hole separated from the second through hole by the pin;

installing a tab at least partially blanking off the first through hole in the first direction, the tab being arranged at a distance from the pin to define a space for the strap to pass between the pin and the tab.

It is yet a further object of the invention to provide a method for adjusting the length of a first strap that is easy to achieve and that enables the chosen length to be well preserved. Such a result tends to be achieved by means of a method for adjusting the length of a first strap comprising the following steps:

providing an adjustment system according to any one of the foregoing configurations;

pulling on the first strap to define the length of the first strap.

DESCRIPTION OF THE DRAWINGS

Other advantages and features will become more clearly apparent from the following description of particular embodiments and implementation modes of the invention given for non-restrictive example purposes only and represented in the appended drawings, in which.

DETAILED DESCRIPTION

Figure 8:
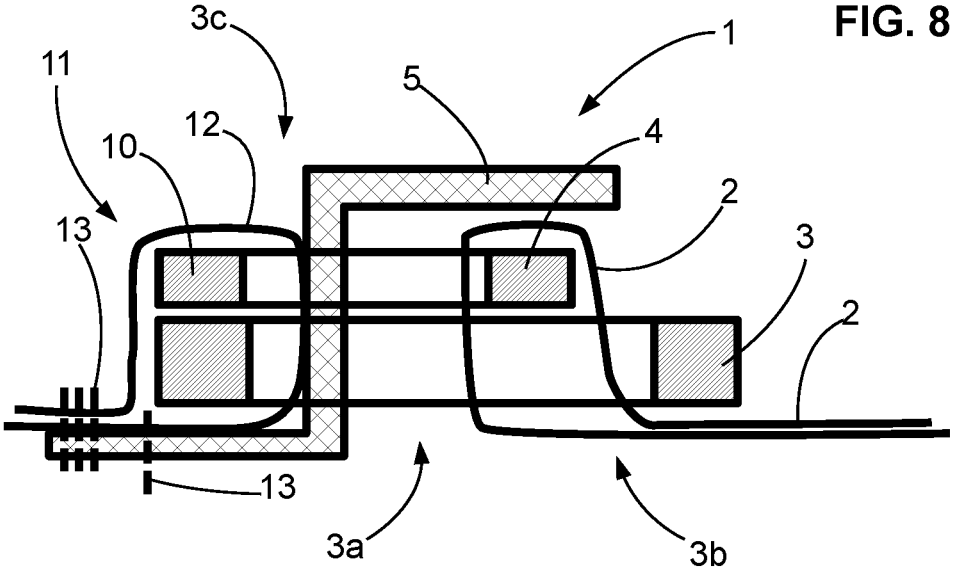
FIG. 8 schematically illustrates a cross-sectional view of an adjustment system according to a fourth embodiment.
Figure 9:
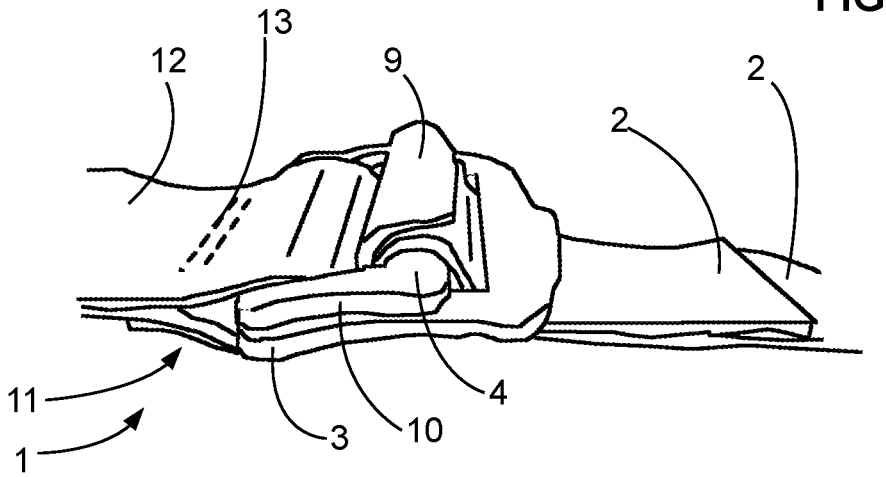
FIG. 9 schematically illustrates another perspective view of an adjustment system according to the fourth embodiment FIG. 10 schematically illustrates a harness comprising an adjustment system according to one embodiment of the invention.
Figure 10:
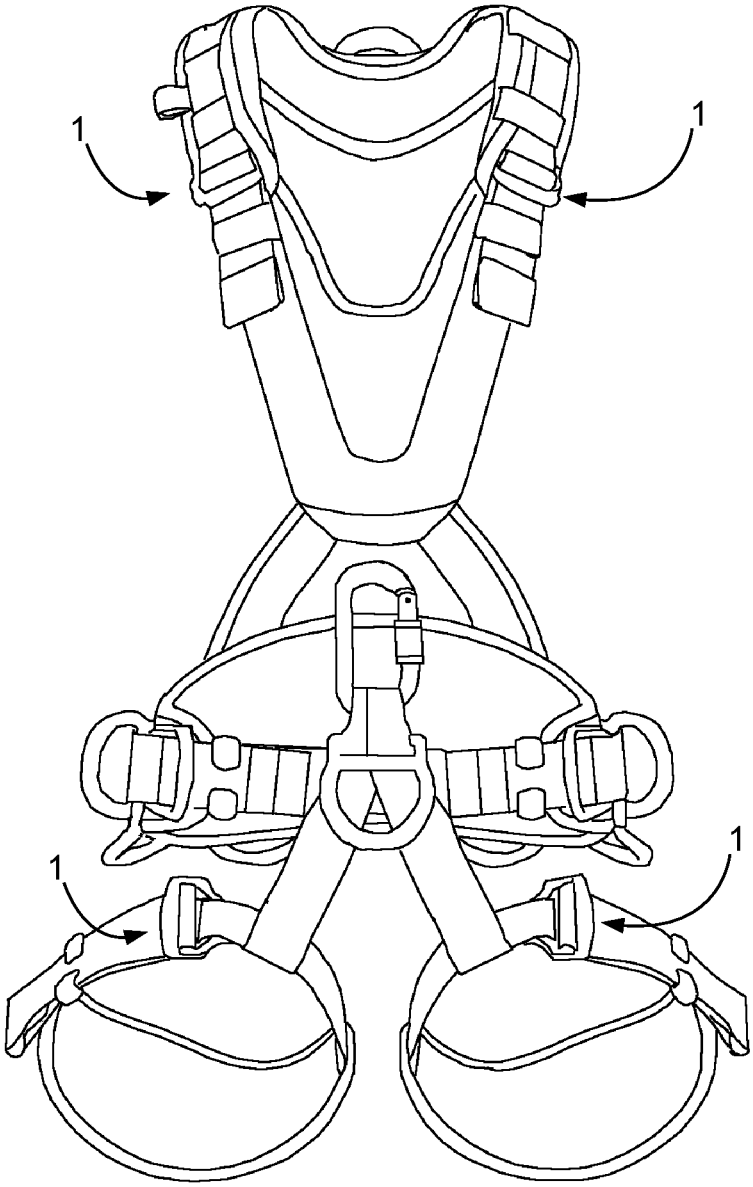

FIGS. 1 to 9 illustrate different embodiments of an adjustment system 1 that is configured to adjust the length of a first strap 2. In preferential manner, adjustment system 1 belongs to an adjustment system of a roping harness intended for working at height and/or for activities in which the user is suspended by means of his harness. The harness can be a mountaineering harness or a harness for canyoning or caving. It may also be a harness for performing tree care work or for other rope access work, for example an operation on a wind turbine. FIG. 10 illustrates a harness comprising the adjustment system 1.

For all these users, it is important for the harness to be able to keep the length of first strap 2 when the user is suspended from the harness which results in a strong force on first strap 2 and therefore on the adjustment means. The adjustment system can be an adjustment system of a leg loop or an adjustment system of a shoulder strap. First strap 2 forms all or part of a leg loop or first strap 2 can form all or part of a shoulder strap.

The inventors observed that under a large number of conditions, when a user adjusts his harness, for example his leg loops, and walks to the required spot, he applies adverse forces on the adjustment system. Different forces are applied on the adjustment system with variable directions and intensities resulting in a loss of adjustment of the adjustment system. As the adjustment system is configured to have easy sliding of the strap to make precise adjustment easy to obtain, this also means that the leg loops can easily become maladjusted during the walking phases. Loss of adjustment of the shoulder straps is also observed with other movements. It is therefore proposed to modify the adjustment system so as to improve the functioning of the adjustment system and to better retain the adjustment of the strap when the strap is not subjected to tension.

Adjustment system 1 comprises a ring 3 defining a first through hole. The first through hole passes through ring 3 in a first direction A. Ring 3 can extend in a first plane as illustrated in cross-section in FIGS. 1, 2, 4 and 8. Ring 3 is then a planar ring. However, it is also possible for ring 3 to be slightly curved. The curvature of ring 3 can be substantially uniform from one end of ring 3 to the other or be localised in one or more places of ring 3 as has already been used in prior art configurations.

Adjustment system 1 has a pin 4 mounted movable with respect to ring 3. Pin 4 partially obstructs ring 3 in the first direction A so as to divide the first through hole into a second through hole 3*a* and a third through hole 3*b*. Third through hole 3*b* is separated from second through hole 3*a* by pin 4 when adjustment system 1 is observed in the first direction A.

To perform adjustment of first strap 2, first strap 2 passes through ring 3 passing through one of the second through hole 3*a* and third through hole 3*b*. First strap 2 passes round pin 4 to pass through ring 3 again passing through the other of second through hole 3*a* and third through hole 3*b*. Pin 4 is mounted movable to move towards or away from a wall of ring 3. When first strap 2 is placed under tension, it pulls on pin 4 which moves towards the wall of ring 3 having the effect of blocking first strap 2 and therefore of securing adjustment of first strap 2 under load. A strand of first strap 2 is jammed between ring 3 and pin 4.

The inventors observed that when walking, the different leg movements tend to induce opposing forces on the strands of the strap on each side of the pin. A leg movement has the effect of moving the upper strand of the first strap 2 which results in a force tending to form a strap loop salient from the adjustment system. With this force, the portion of first strap 2 covering pin 4 moves slightly away from pin 4. As the user continues walking, first strap 2 defines an increasingly large loop. The other strand of the first strap remains jammed against the user's leg. When another leg movement is performed, the other strand of first strap 2 tends to pull on first strap 2 which completes loss of adjustment of first strap 2.

In order to reduce or even eliminate loss of adjustment of first strap 2 when the latter is not under tension or not sufficiently under tension, it is proposed to add a tab 5 that is arranged so as to reduce the length of the loop of first strap 2 salient from ring 3 and from pin 4.

Tab 5 at least partially blanks off the first through hole in first direction A. Tab 5 is arranged at a distance from pin 4 to define a space for first strap 2 to pass between pin 4 and tab 5. Tab 5 covers pin 4 in first direction A. Tab 5 is located at a distance from pin 4 in order not to modify the functioning of pin 4 in the tightening and loosening phases of first strap 2 in the adjustment system. Tab 5 is not pressing on pin 4.

In preferential manner, tab 5 is located at a greater distance from the pin in the first direction A than the thickness of first strap 2 in the first direction A. In this way, when first strap 2 passes round pin 4 pressing on the latter, at least an empty area remains between first strap 2 and tab 5. Choosing a separating distance between pin 4 and tab 5 that is larger than the thickness of first strap 2 avoids placing a friction on first strap 2 which does not penalise adjustment of the length of first strap 2. Tab 5 prevents the formation of too large a loop of first strap 2 thereby reducing or even preventing loss of adjustment. By reducing the height of the loop, undesired lengthening of first strap 2 is reduced.

In a particular embodiment, tab 5 is made from a flexible material. The use of a flexible material allows tab 5 to deform thereby making first strap 2 easier to install in adjustment system 1. The use of a flexible material allows tab 5 to deform which prevents the formation of a hook detrimental to the user's safety. Advantageously tab 5 is made from a polymer material. The distal portion of tab 5 deforms allowing the user to access first strap 2, for example to remove the first strap or on the contrary to facilitate installation of first strap 2.

Different configurations of adjustment system 1 are possible for securing tab 5 to the different parts of adjustment system 1. In one embodiment, tab 5 is fixed to ring 3 only. Such an embodiment is illustrated in FIGS. 1 to 7. These figures also illustrate a preferred embodiment wherein tab 5 is mounted removable with respect to ring 3. The use of a removable tab 5 enables an existing adjustment system to be improved without having to change ring 3. In preferential manner, tab 5 is configured to press against the user. Tab 5 is configured to extend underneath the bottom surface of ring 3 so as to be jammed between the ring and the user.

Figure 3:
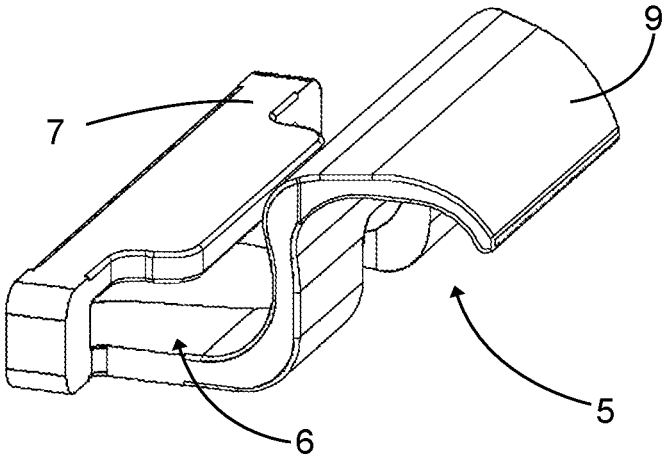
FIG. 3 schematically illustrates a perspective view of a tab designed to be fitted in removable manner on a ring according to the first or second embodiment.

FIG. 3 illustrates a particular configuration of tab 5 that has an open cavity 6 designed to allow insertion followed by embedding of a portion of ring 3. Tab 5 has a support area 7 that is designed to press against the outer surfaces of ring 3 thereby ensuring a good support on ring 3 and to define the separating distance between tab 3 and pin 4 precisely with respect to the thickness of first strap 2. Ring 3 is jammed against support area 7 in open cavity 6.

Figure 4:
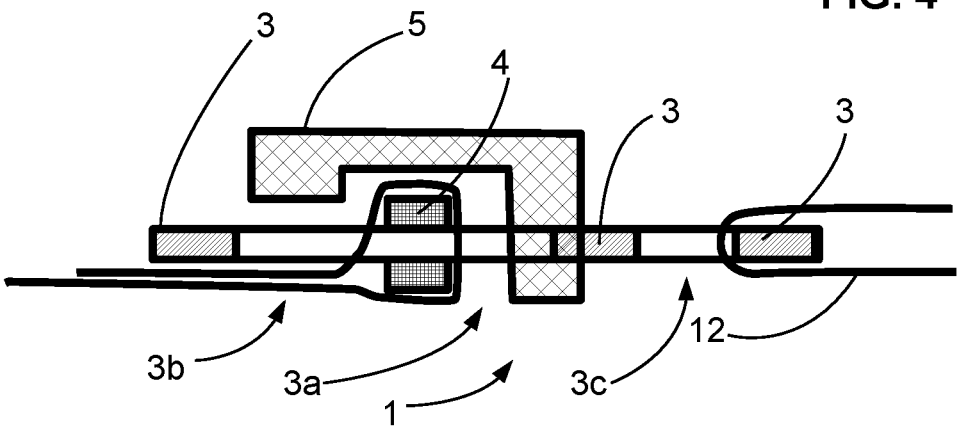
FIG. 4 schematically illustrates a cross-sectional view of an adjustment system according to a third embodiment.
Figure 5:
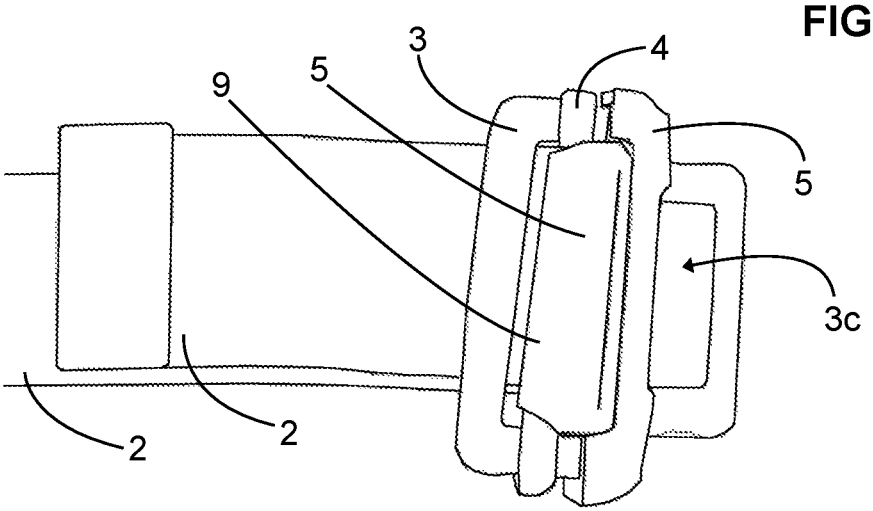
FIG. 5 schematically illustrates a perspective view of an adjustment system according to the third embodiment.
Figure 6:
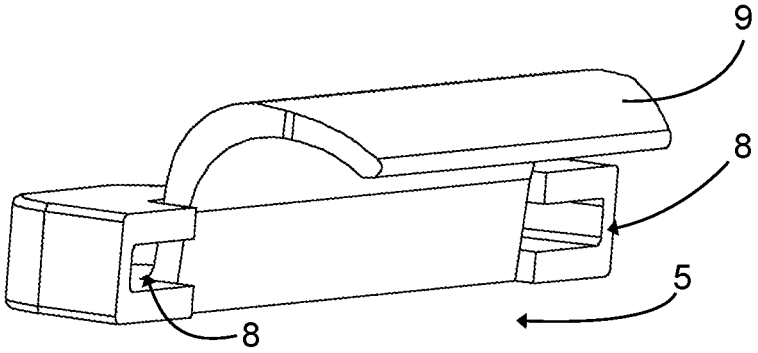
FIG. 6 schematically illustrates a perspective view of a tab designed to be fixed in removable manner on a ring of an adjustment system according to the third embodiment.
Figure 7:
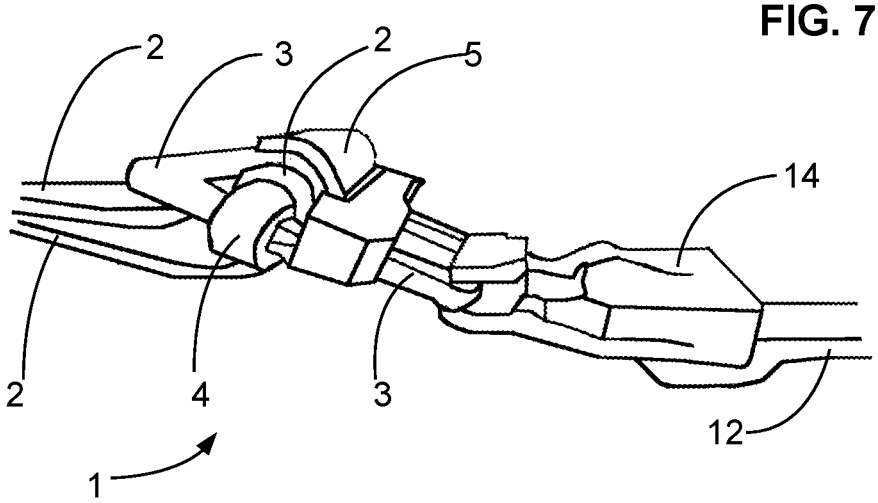
FIG. 7 schematically illustrates another perspective view of an adjustment system according to the third embodiment.

FIGS. 5, 6 and 7 illustrate another configuration of tab 5 fitted on ring 3. FIGS. 5, 6 and 7 illustrate an embodiment where tab 5 is mounted removable with respect to ring 3. FIGS. 4 to 7 illustrate an embodiment wherein tab 5 is mounted movable along ring 3. Tab 5 is movable along the longitudinal axis of the adjustment system which is also the longitudinal axis of first strap 2.

FIG. 6 illustrates a tab 5 provided with two grooves 8 inside which ring 3 can slide. The two grooves 8 are formed at the two transverse ends of tab 5. In preferential manner, obstruction area 9 of tab 5, i.e. the area that at least partially covers the first through hole and pin 4, is located between the two grooves 8. Obstruction area 9 is arranged so as to be flexible with respect to the fixing area of tab 5 with ring 3, another strap or an additional ring.

In an alternative embodiment, tab 5 is moulded from casting on ring 3 or tab 5 forms an integral part of ring 3. Other means for fixing tab 5 to ring 3 are possible.

In another embodiment, adjustment system 1 comprises an additional ring 10 mounted movable with respect to ring 3. Pin 4 forms part of additional ring 10. FIGS. 8 and 9 illustrate an adjustment system 1 comprising a ring and an additional ring 10.

In one particular case, tab 5 is only fixed to additional ring 10. In another embodiment, tab 5 is fixed to ring 3. Tab 5 does not modify the movement of the additional ring 10 with respect to ring 3. In yet another embodiment illustrated in FIGS. 8 and 9, tab 5 is fixed to a securing element 11 that performs fixing between ring 3 and an additional ring 10.

In the embodiment illustrated in FIGS. 8 and 9, securing element 11 is a strap ring that performs securing between ring 3 and additional ring 10 and that allows a relative movement between ring 3 and additional ring 10. The strap ring can be a ring formed at the end of first strap 2 or a ring formed at one end of the second strap. In an illustrated embodiment, tab 5 is fixed to the strap ring by stitching, but any other securing means is possible. Securing element 11 can be formed by a second strap 12 that is in the shape of a loop by means of one or more seams 13.

In another embodiment that is not illustrated, tab 5 defines an annular securing member with a through hole allowing ring 3 and additional ring 10 to pass through so as to form securing element 11. However it is particularly advantageous to use a closed textile loop that secures ring 3 and additional ring 10 in permanent manner. The closed textile loop surrounds a part of the ring and passes through the first through hole. Tab 5 is fixedly mounted on the closed textile loop. Deformation of the closed textile loop allows a slight displacement of obstruction area 9 with respect to pin 4.

In this particular embodiment, it is advantageous for tab 5 to pass through the first through hole thereby making it easier to obtain a tab 5 that is flexible and allows a slight displacement. The foot of tab 5 is arranged to press against the user and against the inner surface of ring 3 thereby limiting the displacement of tab 5 and defining the separating distance between tab 5 and pin 4.

In the different illustrated embodiments, first strap 2 passes through second through hole 3*a* and third through hole 3*b*. First strap 2 passes round pin 4. A first strand of first strap 2 is designed to be jammed between second strand of first strap 2 and ring 3. The traction force applied on the strand of first strap 2 to achieve blocking of the first strap against the ring has the effect of moving obstruction area 9 and first strap 2 away.

It is possible to manufacture the adjustment buckle described in the foregoing by means of the following steps:

- providing a ring 3 defining a first through hole in a first direction A and a pin 4 mounted movable with respect to ring 3, pin 4 partially obstructing ring 3 in the first direction so as to divide the first through hole into a second through hole 3*a* and a third through hole 3*b* separated from second through hole 3*a* by pin 4;
- installing a tab 5 at least partially blanking off the first through hole in the first direction A, tab 5 being arranged at a distance from pin 4 to define a space for first strap 2 to pass between pin 4 and tab 5.

Tab 5 can be installed on an already existing adjustment system 1 which enables adjustment system 1 to be improved making the latter less sensitive to sliding phenomena of first strap 2 when the latter is not under load. Tab 5 is advantageously fixed onto ring 3 which makes the operation easier than fixing on another strap fixed to adjustment system 1. Tab 5 is fixed without removing the other parts of adjustment system 1.

As an alternative, tab 5 is installed on ring 3, on additional ring 10 or on the other strap 12 before the different parts that form adjustment system 1 are assembled.

Adjustment of the length of first strap 2 can be performed by means of an adjustment method comprising the following steps:

providing an adjustment system 1 according to any one of the foregoing configurations;

pulling on first strap 2 to define the length of first strap 2.

It is particularly advantageous for tab 5 not to press on first strap 2 so that the ability of first strap 2 to slide during the adjustment phase is not impaired. As tab 5 does not play any part in blocking of a strand of the first strap between pin 4 and ring 3, the blocking capacity of first strap 2 under load is not impaired.

Tab 5 covers first pin 4 in the first direction A which impairs or hampers formation of a loop of first strap 2. As first strap 2 is not tensioned, the latter does not have the necessary force to deform tab 5 so that the maximum height of the loop of first strap 2 corresponds substantially to the separating distance between pin 4 and tab 5 in the first direction A.

The use of a flexible tab 5 enables the user to deform tab 5 elastically so as to be able to access pin 4 when this is necessary without having to dismantle tab 5. Tab 5 enables loss of adjustment to be reduced or even prevented when first strap 2 is not under load without modifying the functioning of adjustment system 1.

For example, when adjustment system 1 is formed by a ring 3 and an additional ring 10, additional ring 10 can be made to swivel to initiate loosening of first strap 2. Additional ring 10 can press on tab 5 which deforms tab 5. As tab 5 is deformed, the force applied on the two opposite surfaces of first strap 2 between tab 5 and additional ring 10 is insufficient to perform blocking of first strap 2.

Depending on the embodiments, adjustment system 1 can be fixed to a harness or to any other equivalent equipment by a second strap 12 or any other equivalent fixing means.

Figure 1:
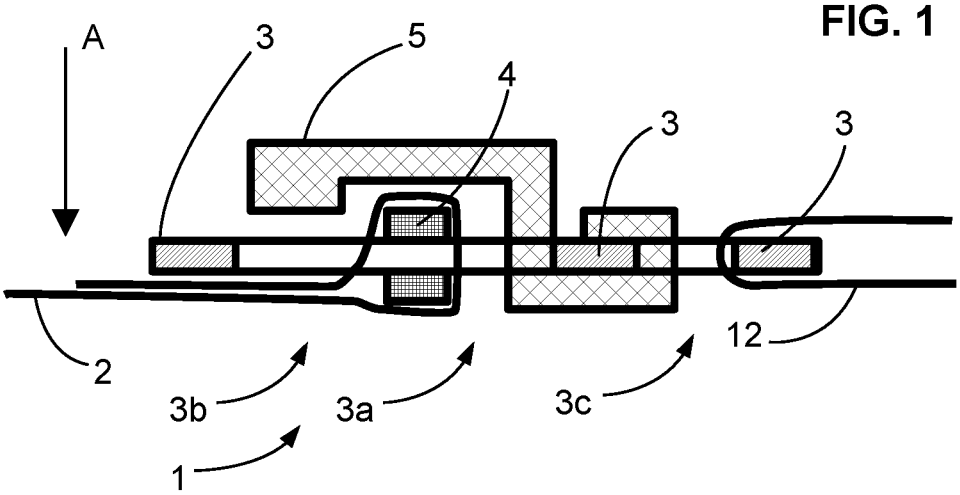
FIG. 1 schematically illustrates a cross-sectional view of an adjustment system according to a first embodiment.
Figure 2:
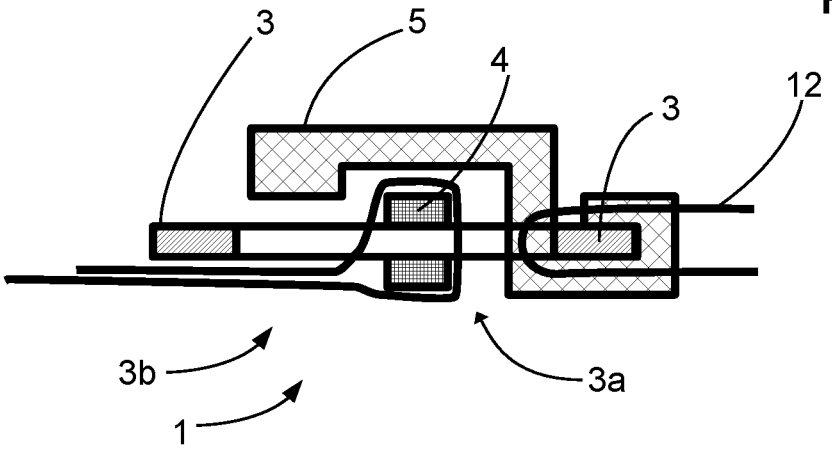
FIG. 2 schematically illustrates a cross-sectional view of an adjustment system according to a second embodiment.

FIG. 1 illustrates a ring 3 with an additional through hole 3*c* or a groove inside which a loop of second strap 12 passes. In the embodiment of FIG. 2, the loop of second strap passes through the first through hole and advantageously through a cavity formed in tab 5.

FIG. 4 illustrates a ring 3 with an additional through hole 3*c* or a groove inside which a loop of second strap 12 passes in identical or substantially identical manner to the configuration of FIG. 1.

FIG. 5 illustrates a ring with a through hole 3*c* that is designed to collaborate with a fixing hook 14 illustrated in FIG. 7. Fixing hook 14 is fixed to second strap 12 but it could be fixed to any other equivalent means. Fixing hook 14 and additional pass-through ring 3*c* can form an opening and closing device of a leg loop which makes it possible to fit a harness while keeping both feet on the ground. Such a device can be used on a shoulder strap or on any other component of a harness.

In advantageous manner, second strap 12 is used to form the closed textile loop. The closed textile loop can be defined by means of a seam 13 that secures two strands of second strap 12 to one another. Seam 13 can be replaced by any other securing means of two strands of webbing strap, for example rivets.

The invention claimed is:

1. An adjustment system configured to adjust a length of a first strap comprising:

a first ring defining a first through hole in a first direction;

a pin mounted movable with respect to the first ring, the pin partially obstructing the first ring in the first direction so as to divide the first through hole into a second through hole and a third through hole separated from the second through hole by the pin when observed along the first direction;

a tab at least partially blanking off the first through hole in the first direction, the tab covering the pin in the first direction, the tab being arranged at a distance from the pin that is greater than a thickness of the first strap to define a space for the first strap to pass between the pin and the tab; and a second ring mounted movable with respect to the first ring, the pin forming a part of second ring and wherein the tab is fixed only to the second ring.

2. The adjustment system according to claim 1 wherein the tab is made from a flexible material.

3. The adjustment system according to claim 2 wherein the tab is made from polymer material.

4. The adjustment system according to claim 1 wherein the tab is installed in removable manner on the second ring.

5. A roping harness comprising the adjustment system according to claim 1 wherein the adjustment system is configured to adjust a circumference of a leg loop or a length of a shoulder strap.

6. A method for adjusting the length of the first strap, the method for adjusting comprising the following steps:

providing an adjustment system according to claim 1;

pulling on the first strap to define the length of the first strap.

7. An adjustment system configured to adjust a length of a first strap comprising:

a ring defining a first through hole in a first direction;

a pin mounted movable with respect to the ring, the pin partially obstructing the ring in the first direction so as to divide the first through hole into a second through hole and a third through hole separated from the second through hole by the pin when observed along the first direction;

a tab at least partially blanking off the first through hole in the first direction, the tab covering the pin in the first direction, the tab being arranged at a distance from the pin that is greater than a thickness of the first strap to define a space for the first strap to pass between the pin and the tab;

a textile loop closed in permanent manner surrounding a part of the ring and passing through the first through hole, and wherein the tab is fixedly mounted on the textile loop.

8. The adjustment system according to claim 7 wherein the tab is made from a flexible material.

9. The adjustment system according to claim 7 wherein the tab is fixed only to the ring.

10. The adjustment system according to claim 7 wherein the tab is installed in removable manner on the ring.

11. A roping harness comprising the adjustment system according to claim 7 wherein the adjustment system is configured to adjust a circumference of a leg loop or a length of a shoulder strap.

12. An adjustment system configured to adjust a length of a first strap comprising:

a ring defining a first through hole in a first direction;

a pin mounted movable with respect to the ring, the pin partially obstructing the ring in the first direction so as to divide the first through hole into a second through hole and a third through hole separated from the second through hole by the pin when observed along the first direction;

a tab at least partially blanking off the first through hole in the first direction, the tab covering the pin in the first direction, the tab being arranged at a distance from the pin that is greater than a thickness of the first strap to define a space for the first strap to pass between the pin and the tab;

wherein the first strap passes through the second through hole and the third through hole and wherein a separating distance between the pin and the tab in the first direction is larger than the thickness of the first strap in the first direction.

13. The adjustment system according to claim 12 wherein the tab is made from a flexible material.

14. The adjustment system according to claim 12 wherein the tab is fixed only to the ring.

15. The adjustment system according to claim 14 wherein the tab is installed in removable manner on the ring.

16. A roping harness comprising the adjustment system according to claim 12 wherein the adjustment system is configured to adjust a circumference of a leg loop or a length of a shoulder strap.

* * * * *